United States Patent [19]

Seeley

[11] Patent Number: 4,604,874

[45] Date of Patent: Aug. 12, 1986

[54] EVAPORATIVE COOLERS

[75] Inventor: Frederic F. Seeley, St. Marys, Australia

[73] Assignee: F. F. Seeley Nominees Pty Ltd., St. Marys, Australia

[21] Appl. No.: 663,772

[22] Filed: Oct. 23, 1984

[30] Foreign Application Priority Data

Oct. 25, 1983 [AU] Australia ..... PG2041

[51] Int. Cl.[4] ..... F25D 19/00

[52] U.S. Cl. ..... 62/298; 62/304; 248/645; 415/204

[58] Field of Search ..... 62/304, 309, 308, 310, 62/298; 248/645; 415/204

[56] References Cited

U.S. PATENT DOCUMENTS 4,479,366 10/1984 Lanier et al. ..... 62/304

*Primary Examiner*—Henry Bennett

*Attorney, Agent, or Firm*—Henry Sternberg; Bert J. Lewen

[57] ABSTRACT

The volute of an evaporative cooler is provided with a flange, and there are provided interengaging surfaces on the volute flange and discharge panel of the cooler retaining those elements in contiguity, and there are further provided at least two pairs of volute support means spaced from one another and from the volute flange such that the volute can function as compression means between the top and bottom panels notwithstanding the direction of discharge of cooled air from the cooler cabinet.

12 Claims, 9 Drawing Figures

EVAPORATIVE COOLERS

This invention relates to improvements in and to an evaporative air cooler, and more particularly to an evaporative cooler which incorporates an integral base tank which serves as a water reservoir. The cooler of this invention is particularly suited for commercial use.

BACKGROUND OF THE INVENTION

It is generally accepted that the major part of the cost involved in the production of large-size commercial evaporative coolers is the assembly cost and the cost of the parts and sub-assemblies which make up the assembly from its component parts, e.g. the support frames for the motor pump and blower assembly. In one known cooler construction, use is made of a bulky "A" frame to support the fan casing (scroll) with respect to the cooler body with both the "A" frame and scroll being of metal construction. Such an arrangement is undesirable in that it is labour intensive and makes use of fasteners such as rivets and screws.

This invention is specifically directed to improvements in an evaporative cooler of the type wherein a cabinet is provided with a top panel, a bottom panel, four side panels, at least some of said panels being pervious, one of said panels being a discharge panel having surfaces defining an exhaust opening therein, a blower comprising an impeller and a volute housing within the cabinet, means for discharging water over the pervious panels, and a motor coupled for drive to the impeller.

In evaporative coolers of the above-defined type, usually it is required that the discharge panel should be directed downwardly so that air passes from an external source above the roof of a building, downwardly through an upwardly directed duct. However there are many instances wherein it is desired to discharge the air horizontally and there are still further instances sometimes encountered wherein it is desired to discharge the air upwardly from the cooler.

If a cooler is formed from metal it can be made rigid but satisfactory corrosion inhibition has been very difficult to achieve without using expensive metals such as marine grade aluminium. Consequently many coolers utilise polymeric panels but a difficulty is then introduced in that the panels are not usually structurally strong unless excessive amounts of polymeric material are used. In normal installations the bottom panel is supported on a substantial substrate, and in order to provide mechanical strength to the cooler it is necessary for any load applied to the cooler to be transmitted downwardly to the bottom panel. While this can be achieved solely by corner posts, this is in itself not always sufficient and one object of this invention is to provide improvements in the construction of a cooler so arranged that the cooler has further compression means capable of transmitting load from the top to the bottom panel. Clearly this is very simply arranged if the elements of the cooler are always in the same configuration (for example a downwardly facing discharge panel). However it is not always simple to achieve this if it is required that the configuration might vary with a minor change only of the elements of the cooler.

The main object of this invention therefore is to provide improvements whereby the blower oriented to discharge downwardly, outwardly through a side panel or upwardly through the upper panel.

BRIEF SUMMARY OF THE INVENTION

Briefly in this invention the volute of an evaporative cooler is provided with a flange, and there are provided interengaging surfaces on the volute flange and discharge panel of the cooler retaining those elements in contiguity, and there are further provided at least two volute support means spaced from one another and from the volute flange such that the volute can function as compression means between the top and bottom panels notwithstanding the direction of discharge of cooled air from the cooler cabinet.

More specifically the invention consists of a flange on the volute, interengaging surfaces on the volute flange and discharge panel retaining the volute flange in face-to-face contiguity with a surface of the discharge panel, at least two pairs of volute support means outstanding from the volute and circumferentially spaced from each other and from the volute flange, and at least one support member extending into the cabinet from a said panel and engageable with one of said volute support means.

While in various embodiments of the invention various locking means can be used between the volute flange and discharge panel, in a preferred embodiment the volute flange is provided with a plurality of elongate apertures and the discharge panel is provided with a corresponding plurality of hook like tongues which extend into the cabinet and which pass through respective said elongate apertures and latch over the inner surface of the volute flange. Thus to achieve assembly it is merely necessary to position the apertures over their respective tongues and move the volute in one direction so as to simultaneously achieve latching of two tongues. A secondary resilient latch can releasably interengage between the discharge panel and volute flange to inhibit release unless that secondary latch is itself first released.

BRIEF SUMMARY OF THE DRAWINGS

Embodiments of the invention are described hereunder in some detail with reference to and are illustrated in the accompanying drawings in which.

DETAILED DESCRIPTION OF THE DRAWINGS

Figure 1:
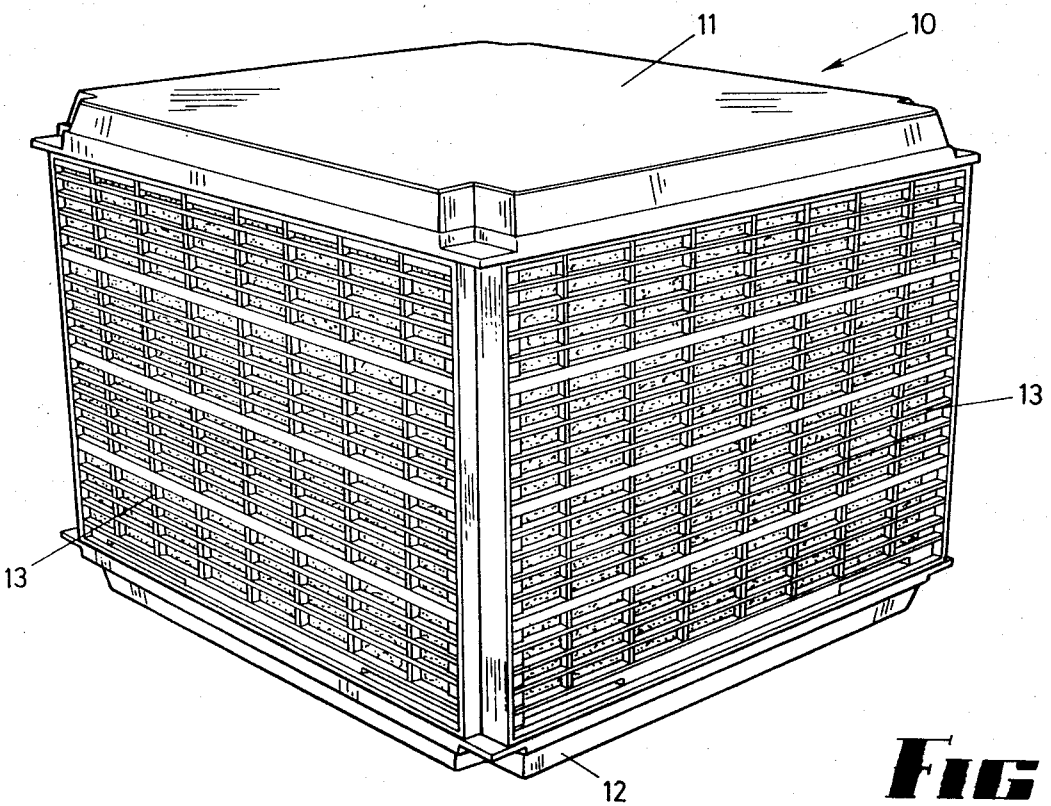
FIG. 1 is a perspective view of an evaporative cooler embodying the invention.

Reference is first made to the embodiment specifically illustrated in FIGS. 1, 2, 5, 6, 7 and 8. The volute shown is described in greater detail in the companion specification the subject of U.S. patent application 611,688 filed 5-18-84 to which the reader is referred.

The evaporative cooler 10 is of the type wherein a cabinet comprises a top panel 11, a bottom panel 12, four side panels 13 each of which is a pervious panel containing woodwool over which water is discharged in accordance with known art. In this embodiment the bottom panel 12 is a discharge panel and also functions as a tank, having upstanding side walls 16 on each of its four sides and interior walls 17 which define with the side walls 16 a discharge opening which is directed downwardly. The upper ends of the interior walls 17 terminate in respective inwardly directed flanges 18 and these flanges 18 lie in face-to-face contiguity with respective flanges 19 which surround the discharge mouth of the volute (scroll) 20 of an impeller fan 21, the impeller fan 21 comprising an impeller 22 driven by a motor (not shown) through a pulley 23 on one end of a square shaft 24. The reader is referred to the companion Australian Application No. PG 2041 filed 10-25-83 entitled "Shaft and Pulley Assembly" which describes this structure in greater detail.

The volute flange 19 is retained in face-to-face contiguity with the flanges 18 of the interior walls 17 by means of a plurality of hook like tongues 28 which project inwardly into the cabinet from the flanges 18, and extend through elongate apertures 29 in the flange 19 of the volute 20. Thus to assemble the volute to the bottom panel 12 it is merely positioned with the elongate apertures 29 over their respective hook like tongues 28 and moved in one direction so that the tongues latch over the inner surface of flange 19. To prevent inadvertent release, one of the walls 17 has an upstanding latch tab 31 (FIG. 7) which springs into a recess 32 in the edge of the volute flange 19.

Figure 3:
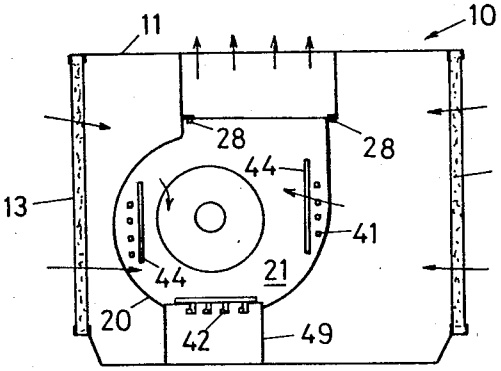
FIG. 3 is a similar diagrammatic section showing the configuration of elements for an upward discharge of cooled air through the upper panel of the cooler cabinet.

As explained in said Australian Patent Application No. 28353/84, the volute 20 comprises two portions 34 and 35 and these are interengaged by latches 36 which extend across an equatorial plane of the volute. FIG. 3 shows the arrangement wherein the top panel 11 is the discharge panel and FIG. 4 where a side panel 39 is a discharge panel, in each instance the discharge panel having the hook like tongues 28 extending inwardly into the cabinet of the cooler. The constructional details of the arrangement of FIG. 4 are shown in FIG. 9.

Figure 2:
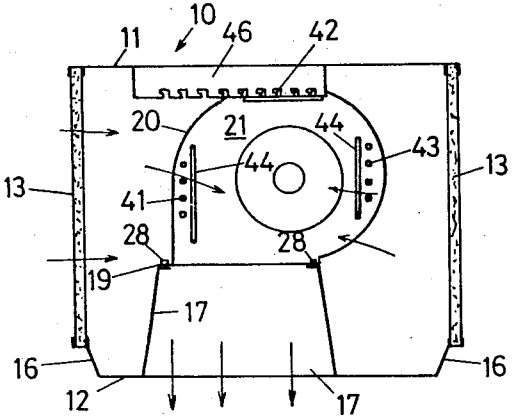
FIG. 2 is a diagrammatic section illustrating the configuration of elements for a downward discharge of the cooled air through the bottom panel.
Figure 4:
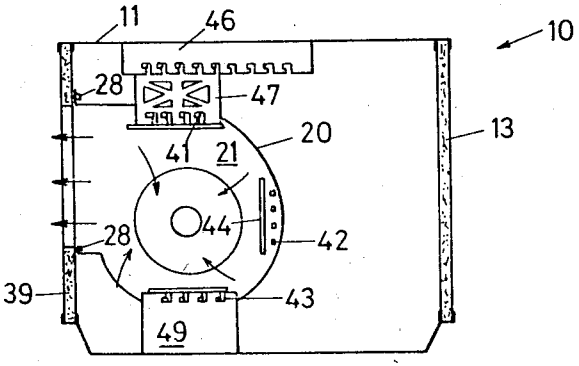
FIG. 4 shows the configuration for the discharge of air through a side panel of a cooler cabinet.
Figure 5:
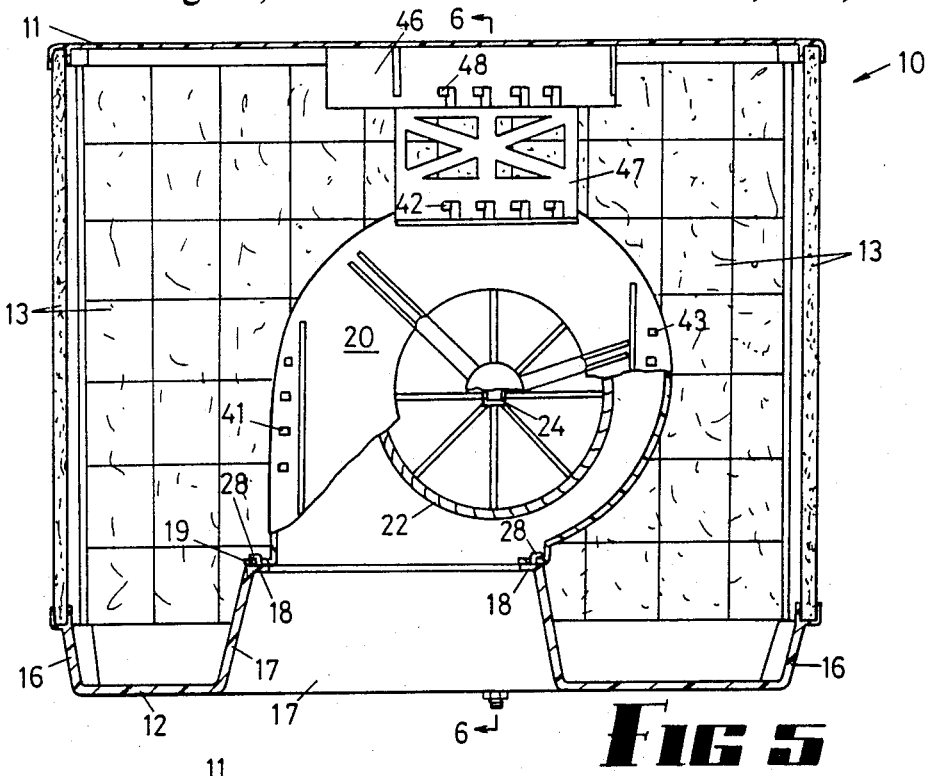
FIG. 5 is a central cross-section corresponding approximately to FIG. 2 and showing constructional details according to a first embodiment (FIG. 5 also corresponding to FIG. 1)
Figure 6:
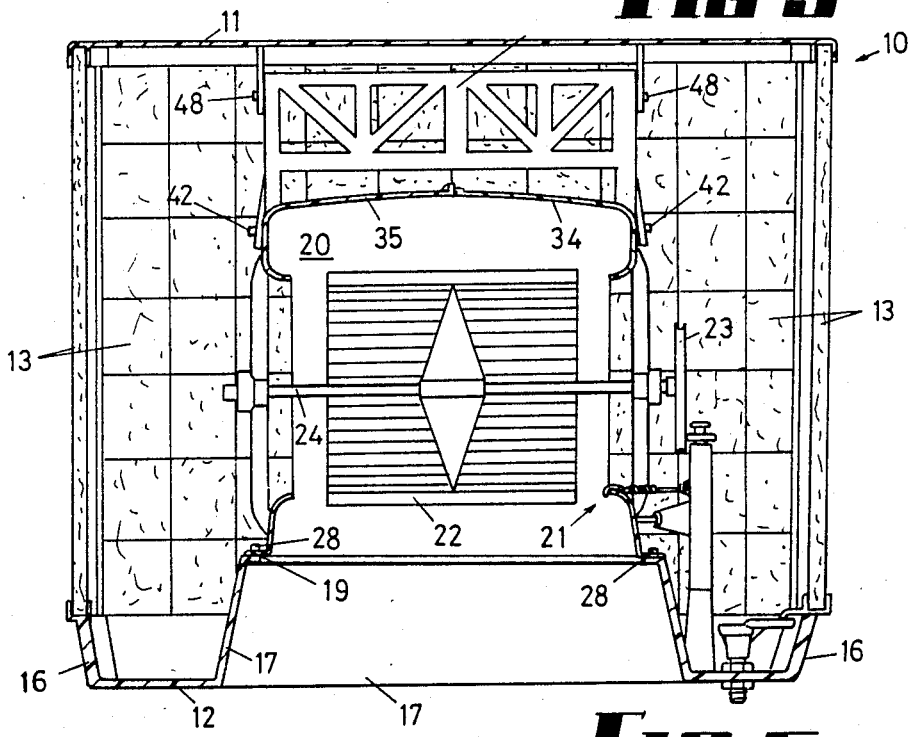
FIG. 6 is an elevational section taken on line 6—6 of FIG. 5.
Figures 7, 8:
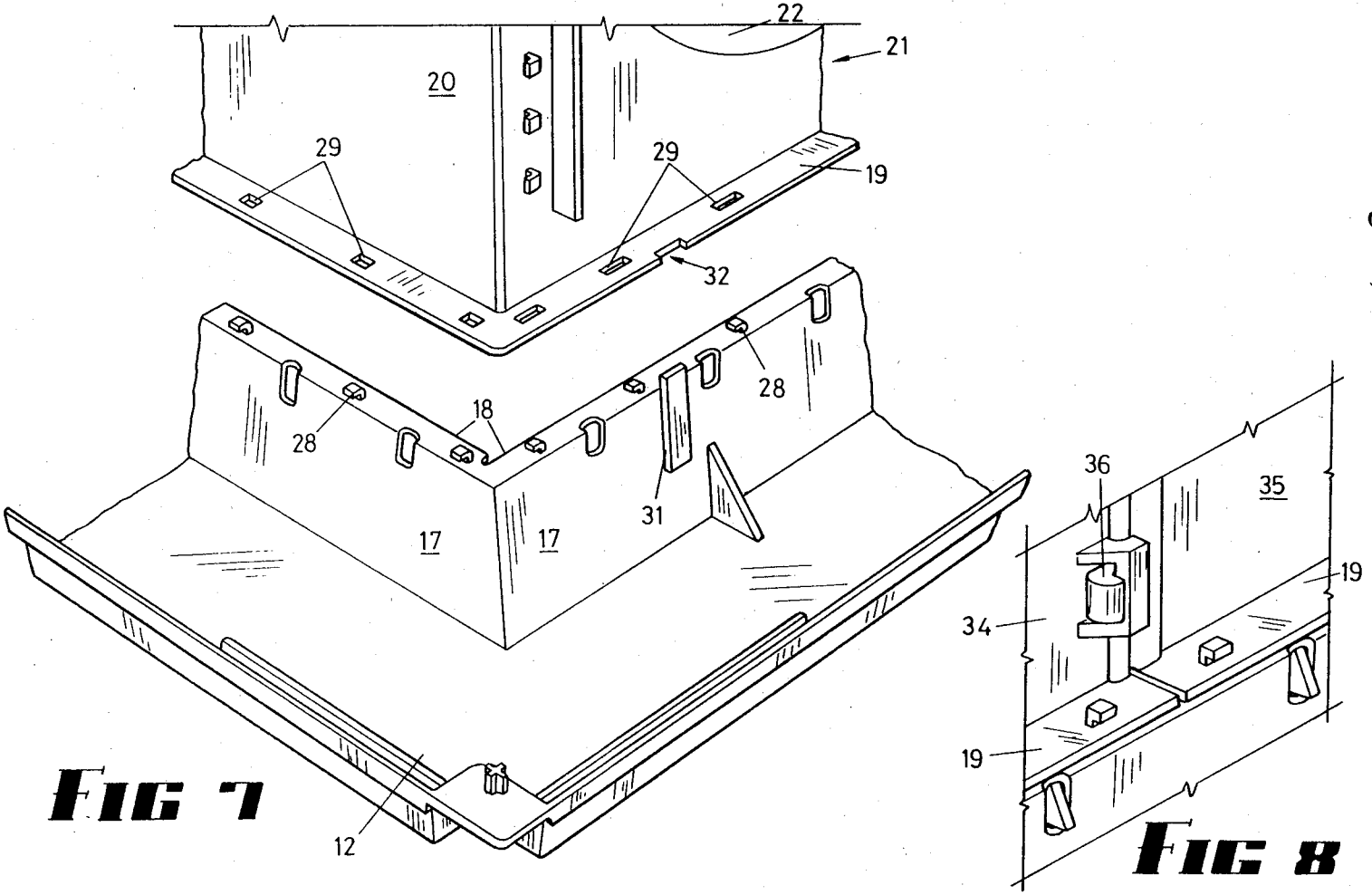
FIG. 7 is a fragmentary "exploded" view showing portion of the bottom panel with its hook like tongues and portion of the volute with its flange and elongate apertures, being drawn to an enlarged scale.
FIG. 8 is a fragmentary perspective view also drawn to an enlarged scale illustrating the interconnection between two halves of the volute and their respective interengagement with hook like tongues.

The respective end of each volute portion 34 and 35 is provided with three rows of hook like tongues respectively designated 41, 42 and 43, the rows 41 and 43 being at right angles to the flange 19, while the row 42 is parallel thereto, and as can be seen best in FIGS. 2, 3 and 4, these rows are circumferentially spaced from one another. Each row of tongues is associated with a respective load support flange 44.

In the first embodiment, the top panel 11 is provided with a depending suspension plate 46, and this either directly engages the tongues 42 as shown in FIG. 2, or in those instances wherein deeper side panels 13 are required to provide increased evaporation area, use is made of a spacer frame 47 (FIGS. 5 and 6) and this has tongues 48 also of hook like shape which engage L-shaped slots in the suspension plate 46. The lower ends of the spacer frame 47 contain L-shaped slots which engage over the row of hook like tongues 42. Thus in the embodiment of FIG. 2 any load applied to the top panel 11 is directly transferred by the volute 20 to the interior walls 17, whereas in the slight variation illustrated in FIGS. 5 and 6, the load also would be transmitted through the spacer frame 47.

Figure 9:
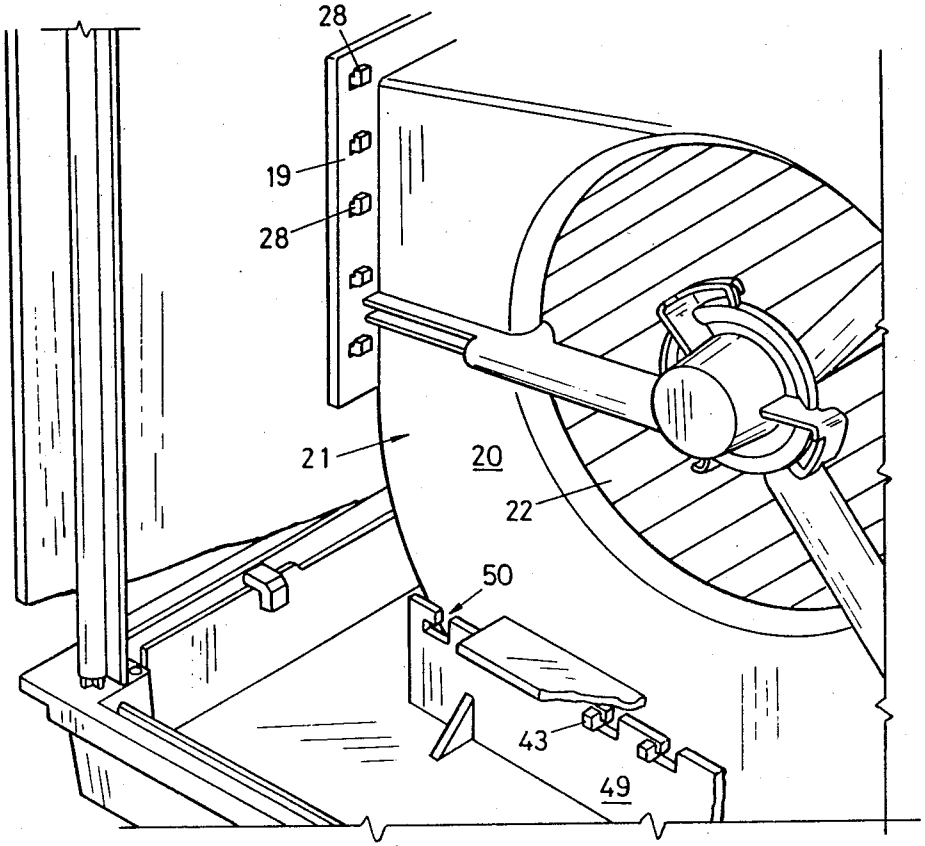
FIG. 9 is a further perspective view illustrating the variation required when the discharge is through a side panel of the cooler cabinet.

In the variation of FIG. 9, which corresponds to FIG. 4, the load is again transmitted by a spacer frame 47 from a pair of suspension spacer plates 46 but in this instance it is transmitted to the row 41 of hook like tongues. In the embodiments of FIGS. 3, 4 and 9, there is also a pair of spacer plates 49 provided which underlie the volute 20, and have L-shaped slots 50 engaged by the row 42 (or 43) of hook like tongues.

I claim:

1. Improvements in an evaporative cooler of the type wherein a cabinet is provided with a top panel, a bottom panel, four side panels, at least some of said panels being pervious, one of said panels being a discharge panel having surfaces defining an exhaust opening therein, a blower comprising an impeller and a volute housing within the cabinet, means for discharging water over the pervious panels, and a motor coupled for drive to the impeller, comprising:

a flange on the volute, interengaging surfaces on the volute flange and discharge panel retaining the volute flange in face-to-face contiguity with a surface of the discharge panel, at least two pairs of volute support means extending outwardly from the volute and circumferentially spaced from each other and from the volute flange, and spacer means extending into the cabinet from a said panel, and interengaging surfaces on at least one pair of support means and each volute support means retaining one of said volute support means to said spacer means.

2. Improvement in an evaporative cooler according to claim 1 wherein said interengaging surfaces comprise tongues on one of said means and surfaces defining slots in the other of said means which interengage with surfaces of said tongues.

3. Improvements in an evaporative cooler according to claim 1 wherein there are six volute support means comprising three on each side of said volute, the volute support means being arranged in aligned pairs, the volute support means of one said pair being parallel to said flange and of each of the other two pairs being at right angles to said flange.

4. Improvements in an evaporative cooler according to claim 3 wherein each said volute support means comprises a row of slot engaging tongues projecting from the volute and a load supporting flange adjacent to said row.

5. Improvements in an evaporative cooler according to claim 1 wherein said spacer means comprises a pair of spacer plates extending into the cabinet from a side panel, the inner edges of the spacer plates each containing a plurality of L-shaped slots which open to that said edge, and wherein each said volute support means comprises a row of tongues which are interengageable with those said slots.

6. Improvements in an evaporative cooler according to claim 5 further comprising a spacer frame having two rows of slots of the same shape and spacing as said slots of the spacer plates, and two rows of slot engaging tongues which are engageable in said slots.

7. Improvements in an evaporative cooler according to claim 1 wherein said interengaging surfaces on the volute flange and discharge panel comprise tongues projecting from the discharge panel and slots in the volute flange the surfaces of which are engaged by said tongues.

8. Improvements in an evaporative cooler according to claim 7 further comprising a secondary resilient latch on the discharge panel releasably engageable with latch surfaces on the volute.

9. Improvements in an evaporative cooler according to claim 1 or claim 2 wherein said exhaust opening is an opening in a base panel of said cabinet.

10. Improvements in an evaporative cooler according to claim 1 or claim 2 wherein said exhaust opening is an opening in a side panel of said cabinet.

11. Improvements in an evaporative cooler according to claim 1 or claim 2 wherein said exhaust opening is an opening in the top panel of said cabinet.

12. An evaporative cooler comprising:

a housing having a top portion, a bottom portion, and a side portion extending between said top and bottom portions, a plurality of wall panels each adapted to be detachably mounted on said housing to respectively cover said portions, at least one of said panels being air pervious, a discharge panel defining an exhaust opening therein for discharge of air there through, said discharge panel being interchangeable with a selected one of said wall panels and adapted to be detachably mounted on said housing in the place of said selected wall panel, a blower comprising an impeller and a volute housing, said volute housing and the wall panels covering said top and bottom portions including fastening means for integrally but detachably connecting said volute housing to both said wall panels covering said top and said bottom portions of said evaporator housing for substantially increasing the structural strength of said evaporator housing between said top and said bottom panels, said fastening means adapted to allow detachable fastening of said volute housing in said evaporator housing in any selected one of three alternative positions, whereby said volute housing provides said structural support in each of such positions, said volute housing having a discharge opening on one side thereof and said three alternatively selectable positions of said volute housing corresponding with the three positions of said volute housing in which said discharge opening is adjacent the exhaust opening of the discharge panel in any of the three alternative locations of that panel.

* * * * *